US008830054B2

(12) United States Patent
Weiss

(10) Patent No.: US 8,830,054 B2
(45) Date of Patent: Sep. 9, 2014

(54) SYSTEM AND METHOD FOR DETECTING AND RESPONDING TO AN EMERGENCY

(75) Inventor: Andrew Weiss, San Ramon, CA (US)

(73) Assignee: WaveMarket, Inc., Emeryville, CA (US)

( * ) Notice: Subject to any disclaimer, the term of this patent is extended or adjusted under 35 U.S.C. 154(b) by 186 days.

(21) Appl. No.: 13/538,318

(22) Filed: Jun. 29, 2012

(65) Prior Publication Data

US 2013/0214925 A1 Aug. 22, 2013

Related U.S. Application Data

(63) Continuation-in-part of application No. 13/399,887, filed on Feb. 17, 2012.

(51) Int. Cl.

| | |
|---|---|
| ***G08B 1/08*** | (2006.01) |
| ***G08B 25/01*** | (2006.01) |
| ***G08B 21/02*** | (2006.01) |
| ***G08B 25/10*** | (2006.01) |

(52) U.S. Cl.

CPC ..... *G08B 25/016* (2013.01); *G08B 21/0241* (2013.01); *G08B 25/10* (2013.01)

USPC ..... 340/539.11; 340/573.4; 455/404.1

(58) Field of Classification Search

CPC .. G08B 25/016; G08B 25/10; G08B 21/0241; G08B 21/025; G08B 21/0288; G08B 21/0291; G08B 21/22

USPC ..... 340/539.11, 539.12, 539.13, 573.4; 455/404.1

See application file for complete search history.

(56) References Cited

U.S. PATENT DOCUMENTS

| | | | | |
|---|---|---|---|---|
| 5,285,586 | A | 2/1994 | Goldston et al. | |
| 6,819,258 | B1 | 11/2004 | Brown | |
| 7,042,338 | B1 * | 5/2006 | Weber | 455/404.1 |
| 7,046,147 | B2 * | 5/2006 | Stigall | 340/539.1 |
| 8,447,279 | B1 | 5/2013 | Peng et al. | |
| 2002/0169539 | A1 | 11/2002 | Menard et al. | |
| 2008/0242311 | A1 | 10/2008 | Craine et al. | |
| 2010/0007503 | A1 * | 1/2010 | Carrington | 340/573.1 |
| 2011/0250904 | A1 | 10/2011 | Valletta et al. | |
| 2011/0294457 | A1 * | 12/2011 | Braznell | 455/404.1 |
| 2012/0072340 | A1 | 3/2012 | Amron | |
| 2012/0196538 | A1 | 8/2012 | Mateu | |
| 2013/0021788 | A1 | 1/2013 | Mayes | |
| 2013/0177006 | A1 | 7/2013 | Baek et al. | |
| 2014/0099921 | A1 | 4/2014 | Weiss | |
| 2014/0099972 | A1 | 4/2014 | Weiss | |

OTHER PUBLICATIONS

C. Thompson, J. Milte, B. Dougherty, A. Abright, and D. C. Schmidt, "Using smartphones to detect car accidents and provide situational awareness to emergency responders.," in MOBILWARE'10, (Chicago, IL, USA), pp. 29-42, 2010.

U.S. Appl. No. 14/195,351, filed Mar. 3, 2014.

* cited by examiner

*Primary Examiner* — John A Tweel, Jr.

(74) *Attorney, Agent, or Firm* — Dovas Law, P.C.

(57) ABSTRACT

A computer-implemented method is provided including receiving sensor data from a mobile device corresponding to a first user. A user state of the first user is predicted based on the sensor data. A request is transmitted to the first user to confirm the predicted user state, and a notification is transmitted regarding the predicted user state to a second user responsive to the first user's confirmation of the predicted user state or the first user's failure to respond to the request. A computing system for monitoring and reporting activity of a mobile device is also provided.

45 Claims, 4 Drawing Sheets

SYSTEM AND METHOD FOR DETECTING AND RESPONDING TO AN EMERGENCY

CROSS REFERENCE TO RELATED APPLICATION(S)

This application is a continuation-in-part of U.S. patent application Ser. No. 13/399,887, filed Feb. 17, 2012, which is incorporated by reference as if fully set forth.

BACKGROUND

There is a segment of the population which would benefit from active behavioral monitoring and behavioral assessment to detect emergency situations and medical anomalies. Active behavioral monitoring and assessment may be particularly beneficial to children, the elderly, the disabled, and those recovering from surgery or recent trauma, especially when such persons are not located in a facility that provides appropriate patient supervision. Children may be more likely to encounter hazardous situations. Persons who are cognitively disabled for example may be more likely to become lost or disoriented. Persons who are physically disabled for example may be more likely to fall and become unconscious. Certain persons' medical history may distinguish them to be more likely to have a seizure. Timely detection of an emergency situation or medical anomaly such as disorientation, seizure, or physical injury is often critical to prevent injury, aggravation of an existing condition, or fatality.

SUMMARY

The invention provides a computer-implemented method including receiving sensor data from a mobile device corresponding to a first user. A user state of the first user is predicted based on the sensor data. A request is transmitted to the first user to confirm the predicted user state, and a notification is transmitted regarding the predicted user state to a second user responsive to the first user's confirmation of the predicted user state or the first user's failure to respond to the request.

The invention further provides a computing system including at least one memory comprising instructions operable to enable the computing system to perform a procedure for monitoring and reporting activity of a mobile device corresponding to a first user, the procedure including receiving sensor data from a mobile device corresponding to a first user. A user state of the first user is predicted based on the sensor data. A request is transmitted to the first user to confirm the predicted user state, and a notification is transmitted regarding the predicted user state to a second user responsive to the first user's confirmation of the predicted user state or the first user's failure to respond to the request.

The invention further provides non-transitory computer-readable media tangibly embodying a program of instructions executable by a processor to implement a method for controlling activity of a mobile device corresponding to a first user, the method including receiving sensor data from a mobile device corresponding to a first user. A user state of the first user is predicted based on the sensor data. A request is transmitted to the first user to confirm the predicted user state, and a notification is transmitted regarding the predicted user state to a second user responsive to the first user's confirmation of the predicted user state or the first user's failure to respond to the request.

The invention further provides a computer-implemented method for monitoring and reporting mobile device user activity comprising receiving sensor data from a mobile device corresponding to a first user. An emergency situation is predicted corresponding to the first user based on the sensor data. A request is transmitted to the first user to confirm the predicted emergency situation, and a notification is transmitted regarding the predicted emergency situation to a second user responsive to at least one of the first user's confirmation of the predicted emergency situation and the first user's failure to respond to the request.

The invention further provides a computing system including at least one non-transitory memory comprising instructions operable to enable the computing system to perform a procedure for monitoring and reporting mobile device user activity. The procedure includes receiving sensor data from a mobile device corresponding to a first user. An emergency situation is predicted corresponding to the first user based on the sensor data. A request is transmitted to the first user to confirm the predicted emergency situation, and a notification is transmitted regarding the predicted emergency situation to a second user responsive to at least one of the first user's confirmation of the predicted emergency situation and the first user's failure to respond to the request.

The invention further provides non-transitory computer-readable media tangibly embodying a program of instructions executable by a processor to implement a method for monitoring and reporting mobile device user activity. The method includes receiving sensor data from a mobile device corresponding to a first user. An emergency situation is predicted corresponding to the first user based on the sensor data. A request is transmitted to the first user to confirm the predicted emergency situation, and a notification is transmitted regarding the predicted emergency situation to a second user responsive to at least one of the first user's confirmation of the predicted emergency situation and the first user's failure to respond to the request.

BRIEF DESCRIPTION OF THE DRAWING(S)

The foregoing Summary as well as the following detailed description will be readily understood in conjunction with the appended drawings which illustrate embodiments of the invention. In the drawings.

DETAILED DESCRIPTION OF ILLUSTRATIVE EMBODIMENT(S)

Figure 1:
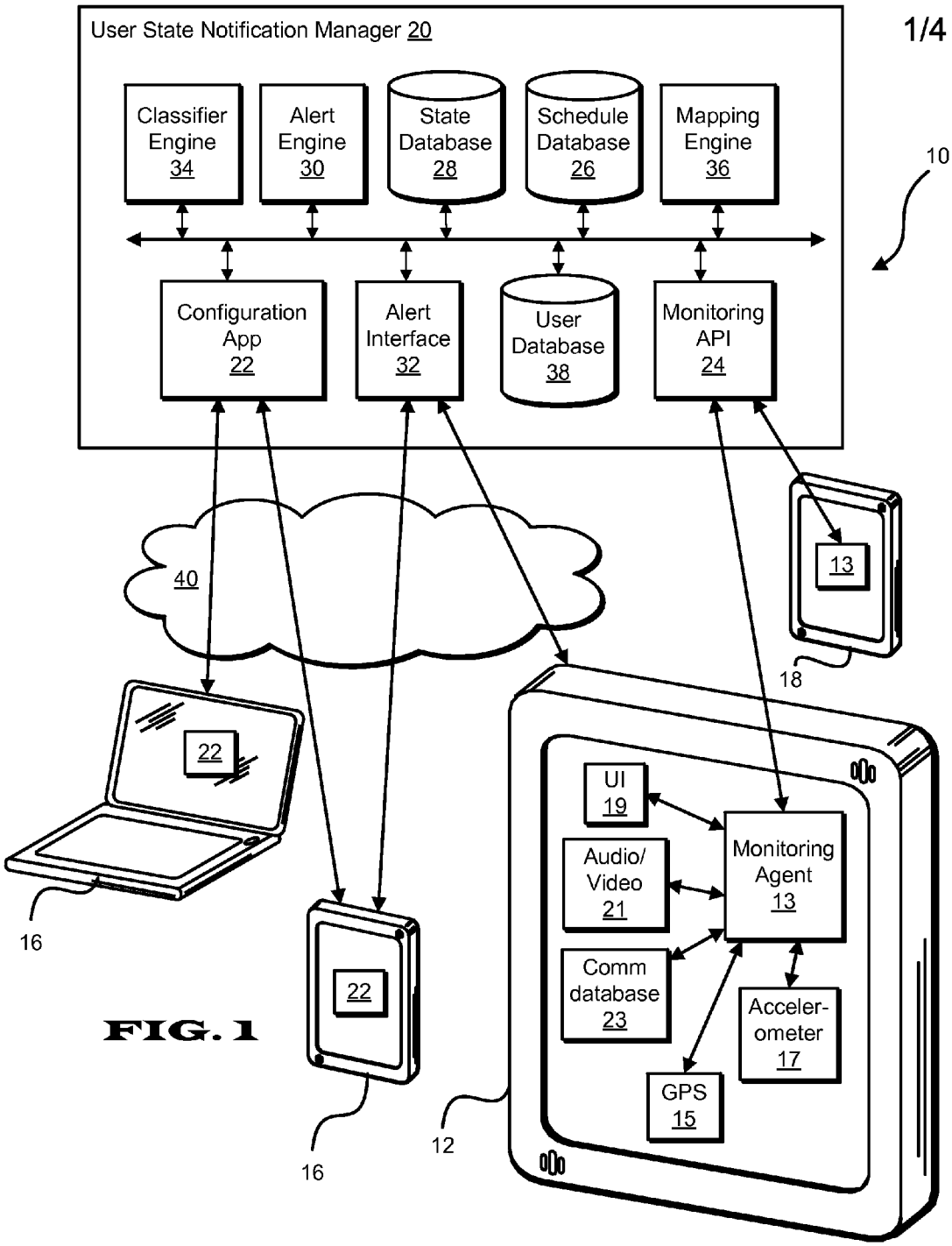
FIG. 1 shows a system for providing a user state notification according to the invention.

Embodiments of the invention are described below with reference to the drawing figures where like numerals represent like elements throughout.

Referring to FIG. 1, a system 10 is provided including a user state notification manager 20 ("notification manager 20") used for providing notification regarding a particular user's state to another user. The user's state preferably corresponds to the user's physical condition, for example whether the user is predicted to have fallen or to have become unconscious, whether the user is predicted to be disoriented or having a seizure or experiencing another medical anomaly. Such medical anomaly corresponds to an emergency situation. The user's state can further correspond to other emergency situations whether or not related to the user's physical condition. An emergency situation can additionally correspond for example to a car accident or a detected deviation from a predetermined route or activity.

The state notification manager 20 enables a configuration application 22, a monitoring application program interface ("API") 24, a schedule database 26, a state database 28, an alert engine 30, an alert interface 32, a classifier engine 34, a mapping engine 36, and a monitoring user database 38. The notification manager 20 can be implemented on one or more network accessible computing systems in communication via a network 40 with a mobile communication device 12 which corresponds to a monitored user and is monitored via a monitoring agent 13. Alternatively, the notification manager 20 or one or more components thereof can be executed on the monitored mobile communication device 12 or other system. The configuration application 22 includes a web application or other application enabled by the notification manager 20 and accessible to a client device 16 via a network and/or executed by the client device 16.

Software and/or hardware residing on a monitored mobile communication device 12 enables the monitoring agent 13 to provide an indication of a medical anomaly or other emergency situation to the notification manager 20 via the monitoring API 24, or alternatively, to provide the notification manager 20 with data for determining a medical anomaly or other emergency situation. The mobile device 12 can include for example a smartphone or other cellular enabled mobile device preferably configured to operate on a wireless telecommunication network. In addition to components enabling processing and wireless communication, the mobile device 12 includes a location determination system, such as a global positioning system (GPS) receiver 15 and an accelerometer 17 from which the monitoring agent 13 gathers data used for predicting a user's state. A monitored user carries the mobile device 12 on their person with the monitoring agent 13 active.

Figure 2:
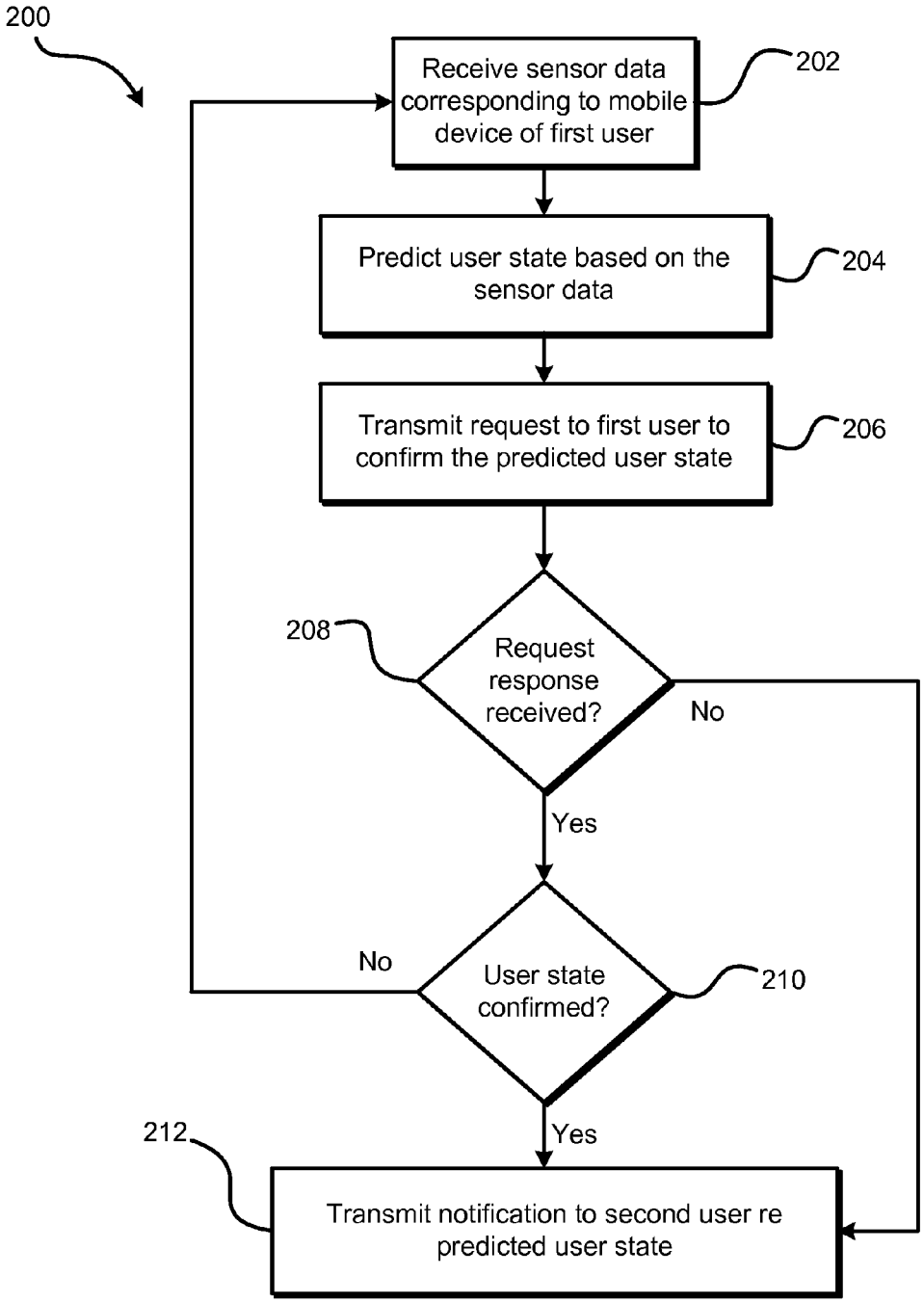
FIG. 2 is a diagram showing a method for providing a user state according to the invention.

Referring to FIG. 2, a method 200 for providing notification of a user state, for example corresponding to an emergency situation, is shown. The method 200 is described with reference to the components shown in the system 10 of FIG. 1, including the notification manager 20 and monitoring agent 13, which are preferably configured for performing the method 200. The method 200 may alternatively be performed via other suitable systems. The method 200 includes receiving sensor data from a mobile device, for example the mobile device 12, corresponding to a first user (step 202), for example a monitored user. A user state of the first user is predicted based on the sensor data (step 204). The predicted user state can correspond to a medical anomaly or other emergency situation, for example a prediction that the user has fallen ("fall state"), has become unconscious ("unconscious state"), has become disoriented or is wandering ("wandering state"), has experienced a seizure ("seizure state"), has been involved in a vehicular accident ("vehicular accident state"), or has deviated from a predetermined route or activity pattern. A request is transmitted to the first user, for example via the mobile device 12, to confirm the predicted user state (step 206). If a response to the request is not received (step 208) or a response is received confirming the predicted user state (step 210), a notification regarding the predicted user state is transmitted to a second user (step 212), a monitoring user, for example a notification generated by the alert engine 30 transmitted via the alert interface 32. Alternatively, if the first user responds with an indication that the predicted user state is invalid (step 210), the process returns to step 202 and a notification is not transmitted to the second user.

The sensor data preferably includes device acceleration data from an accelerometer 17 on the mobile device 12. The sensor data can further include position, time and velocity data from the GPS 15 or other location determining system, for example a system incorporating cell site interpolation. Sensor data can be resolved to predict the user state by executing a classifier on the mobile device 12, for example via the monitoring agent 13, or by executing the classifier on a remote system in communication with the mobile device 12 through a network, for example via the notification manager 20. In addition to sensor data, a collection of predetermined conditions, provided for example by a monitoring user via a device 16, can be input to the classifier for determining the user state. The classifier includes an algorithm for identifying the states to which new observations belong, where the identity of the states is unknown. The classifier is trained prior to implementation based on received training data including observations corresponding to known states, for example known emergency situations, and can be continually retrained based on new data to enable a learning process.

The request to confirm the predicted user state, for example corresponding to an emergency situation, can be transmitted from the notification manager 20 to a monitored user via the monitoring agent 13 on the monitored user's mobile device 12. The notification manager 20 is configured to receive via the monitoring agent 13 a confirmation from the monitored user that the prediction of the user state is valid or an indication that the prediction of the user state is invalid. For example, a one touch user interface can be enabled by the monitoring agent 13 to allow the monitored user to confirm or invalidate the predicted user state. A test questionnaire can be provided to the monitored user to permit confirmation or invalidation of one or more determined user states. Alternatively, the request to the monitored user to confirm the predicted user state can be performed by initiating a telephone call to the monitored user's mobile device 12, for example via the alert interface 32, wherein the user response can be received as a voice or tone signal. Alternatively, transmitting the request or receiving a response from the monitored user can be performed by any suitable synchronous or asynchronous communication process.

The request can be repeated at a predetermined time interval, for example every 10 minutes, until a response is received from the monitored user. This interval can be user configurable, for example configurable by the monitoring user via the configuration application 22. The request can further require a confirmation code preferably known only to the monitored user so it is known that the response to the request originated from the monitored user. Requiring a confirmation code may be beneficial to prevent another party from providing a false indication of the condition of the monitored user.

Collected sensor data is selectively applied by the classifier engine 34 to the classifier from which the state was determined with an indication that the prediction of the user state is valid or invalid to retrain the classifier. A request can further be provided to a monitoring user, for example via the client device 16, to confirm the predicted user state, which responsive data can be further used in a classifier retraining process.

In the case of a predicted emergency situation, the notification manager 20 requests confirmation from the user of whether or not there exists an actual emergency situation, and if so, requests details regarding the emergency situation for transmission to a monitoring user. If the monitored user is in an emergency situation, it is requested that the monitored user provide an indication of whether or not the user is injured or otherwise disabled. If the user is in an emergency situation and injured or disabled, the user is requested to provide, if capable, an indication of the degree of injury or disability. If an emergency situation is predicted and no response is received from the monitored user within a predetermined period of time, for example thirty seconds, a notification is sent to a monitoring user including an indication of the predicted emergency situation.

Based on the predicted emergency situation and the confirmation including details received, or the lack of a confirmation, the notification manager 20 is configured to make a determination as to which of a plurality of prospective monitoring users it would be appropriate to transmit a notification regarding the predicted emergency situation. For example, by accessing a database of monitoring users 38 the notification manager can determine based on a type of predicted emergency situation and type of confirmation (or lack thereof) whether a police department, emergency medical team (EMT), 911 call center, or caretaker responsible for the monitored user would be appropriate to handle the emergency situation, and contact the monitoring user determined to be appropriate.

The classifier preferably includes a plurality of components, wherein each component is configured to resolve a particular collection of inputs to predict the user state, for example a user state corresponding to an emergency situation. A component for predicting a motor vehicle accident is configured to resolve sensor data including device acceleration data, for example from accelerometer 17, and device position data with associated time data, for example from the GPS receiver 15 or other location determining system. A component for predicting a user has fallen down ("fall state") is configured to resolve sensor data including device acceleration data, for example from accelerometer 17, and device position data with associated time data, for example from the GPS receiver 15 or other location determination system. The classifier component for detecting a fall state for the user can be defined using a predetermined decision tree acting from accelerometer inputs, optionally conditioned by a Markov model for a potential improvement in accuracy. Velocity data, derived for example from the GPS receiver 15 ("GPS velocity data"), can be used to confirm a fall state, for example, by confirming that the user has no apparent velocity or small apparent velocity, the latter accounting for any error in velocity determination.

A classifier component for predicting a user is wandering or disoriented ("wandering state") is configured to resolve sensor data including device acceleration data, device position data, and optionally, device velocity data (e.g. GPS velocity data). The wandering state can be determined for example by determining a distance traveled by a first user based on the position data over a particular predetermined time period, determining a distance between a first point at a start of the predetermined time period and a second point at an end of the predetermined time period, and predicting the wandering state based on the distance traveled and the distance between the first point and the second point. For example, the detection of wandering may take as input the ratio of a series of location determination system readings, such as GPS readings that reflect the distance covered by the monitored user over some period of time, divided by the distance between the endpoints of that path; the ratio can be an input into a decision tree that is a classifier component for this wandering behavior.

Alternatively, a wandering state can be determined by determining a "walking state" that lacks purposeful intent, wherein purposeful intent is deemed present responsive to the monitored user stopping at a friend's home, stopping at a venue, or stopping at another significant location. Lack of purposeful intent follows a general demonstration of a lack of stopping during a prolonged period of walking or other traveling manner. Significant locations can be designated for example by the notification manager 20 or via inputs by the monitoring user. A monitored user's failure to stop for a predetermined period of time at the designated location in his or her path of travel, as determined from the position data, can result in a prediction of the wandering state. Conversely, visits to friends, venues, or extended stops at particular locations demonstrate an intent to visit, as opposed to an aimless walk, providing evidence of purposeful intent opposing a prediction of a wandering state. Location determination system data, such as GPS velocity data and accelerometer data can be used to confirm that the monitored user is walking or traveling in another manner. The locations of homes of friends of the monitored user, and venues in an area frequented by the monitored user, can be included as part of the state database 28. Known or suspected prior ingestion of medication known to possibly cause a disoriented state can also be included as a condition for deriving the classification of wandering behavior.

A classifier component for predicting a user is unconscious ("unconscious state") is configured to resolve sensor data including device acceleration data, device position data, and device velocity data. The position data can include an indication of the distance traveled, if any distance is traveled during a predetermined time period. For example, the classifier component can include a decision tree acting from accelerometer inputs with secondary processing by a Markov model, takes as input distance covered, derived from location determination system readings, such as GPS readings, to confirm lack of motion. A predetermined condition that indicates that the user may be affected by medication ingested at some threshold prior period of time, in a way that increases the probability of an unconscious state, can also be an input to this support vector machine.

A classifier component for predicting a vehicular accident ("vehicle accident state") is configured to resolve sensor data including device acceleration data, device position data, and device velocity data. For example, a rapid decrease from a relatively high velocity coupled with the detection of impact-level deceleration is indicative of a vehicle accident. A classifier can be used to relate the particulars of a situation to determine that an auto accident has occurred.

As an alternative to implementing a single classifier with multiple components for predicting multiple user states, a plurality of classifiers can be applied to the sensor data to predict a user state, wherein each of the plurality of classifiers corresponds to one or more user states, for example a fall state classifier, a wandering state classifier, an unconscious state classifier, and a vehicular accident classifier.

A classifier can include a decision tree or other static or dynamic classifier and can be conditioned by a Markov model. The classifier can be trained based on received training data including sensed data from a particular device and an indication of one or more known states corresponding to the sensed data. For example, sensor data from a mobile device carried by or attached to a test user known to have experienced a fall state, an unconscious state, a wandering state, a seizure state, or a vehicular accident when the test data was generated can be used to train the classifier. Alternatively, sensor data from a mobile device carried by or attached to a test user who physically simulates a fall state, an unconscious state, a wandering state, seizure state, or vehicular accident when the test data is generated can be used to train the classifier. Training sensor data is received via the configuration application 22 of the notification manager 20 from a test device, training is performed via the classifier engine 34, and trained classifiers are stored in the state database 28. To predict a user state of a monitored user, trained classifiers are applied to sensor data from a monitored device 12. A classifier can be executed locally on the device 12, for example via the monitoring agent 13, or on a remote system which receives the sensor data via a network, for example via the classifier engine 34 of the notification manager 20 implemented on a network-accessible system.

The confirmation/refutation of predicted user states, from either the monitored user through the device 12, or the monitoring user through the device 16, can be used as training data to re-train classifiers used to predict the user states. For example, if the classifier (or classifiers) predicts that the user is unconscious ("unconscious state"), and a corresponding confirmation request is sent to the monitored user, which the monitored user refutes, then the classifier or classifiers used to make the unconscious state prediction can be incrementally retrained based on the refutation. The classifier or classifiers in the classifier engine 34 are updated accordingly.

The notification manager 20 is further configured to receive an indication of a geographic area, for example from the monitoring user via the configuration application 22, and to determine if the monitored device has entered or exited the geographic area. The user state of the monitored user is predicted based on the indication of the geographic area if the monitored device has entered, or alternatively, exited the geographic area. The indication of the geographic area includes a designation that the first user is predicted to be active or passive in the geographic area, wherein a classifier used for predicting the user state is specific to the geographic area corresponding to an active designation, and another classifier used for predicting the user state is specific to the geographic area corresponding to a passive designation. The indication that the monitored user has entered, or alternatively exited, the geographic area along with the geographic area's designation is provided as an input to a classifier. For example, if the geographic area corresponds to the bedroom of a monitored user, and the designation indicates the user is likely to be passive therein, that is, likely to be asleep when in the bedroom, the classifier used to predict an "unconscious state" or "wandering state" is one conditioned for passive behavior, when, based on position data, the user is determined to be in the bedroom. Conversely, if the geographic area corresponds to a particular undeveloped wilderness area, and the designation indicates the user is likely to be active, that is, likely to be disoriented when in the particular undeveloped wilderness area, the classifier used to predict an "unconscious state" or "wandering state" is one conditioned for active behavior, when, based on position data, the user is determined to be in the particular undeveloped wilderness area. A first classifier can be applied when the geographic area where the monitored user is located corresponds to an passive designation and a second classifier can be applied when the geographic area where the monitored user is located corresponds to a active designation, wherein the second classifier is trained to be more likely to predict the user state than the first classifier given the same input data. In one example implementation, a threshold for predicting the user state can be relatively lower if the geographic area corresponds to an active designation, and a threshold for predicting the user state can be relatively higher if the geographic area corresponds to a passive designation.

In another implementation, predicting the user state or transmitting the notification to a monitoring user of a predicted user state are performed responsive to determining the mobile device has entered, or alternatively, exited the geographic area, wherein the monitored user's entrance to or exit from the geographic area operates as a trigger to initiate monitoring of a user, allowing the classifier to generate a user state prediction and allowing the monitoring user to be notified of the predicted user state. For example, a user who is located in a geographic area corresponding to a hospital or care facility may not require monitoring until such time as the user leaves the hospital or care facility.

In another implementation, the notification manager 20 is configured to receive an indication of a geographic area from a user with an indication of a predetermined time period. The mobile device is determined to have entered or exited the geographic area, for example determined via the mapping engine 36. Entering, or alternatively, exiting the geographic area during the predetermined time period triggers monitoring of a monitored user, wherein predicting the user state and transmitting a notification regarding the user state to a monitoring user is performed responsive to determining the mobile device has entered or exited the geographic area during the predetermined time period. For example, a monitored user's presence outdoors at a particular public park between 10 pm and 6 am triggers monitoring by the monitoring agent 13, whereas a monitored user's presence at the public park between the hours of 6 am and 10 pm does not trigger monitoring and predicting a user state.

The notification manager 20 is further configured to determine a venue corresponding to a particular geographic area using mapping data including business directory information, compiled for example via the mapping engine 36. In addition to sensor data, venue data is input to the classifier and the user state is based further on the determined venue responsive to the mobile device entering or exiting the geographic area. The geographic area corresponding to the determined venue can correspond to a classifier trained for predicting the user state corresponding to that venue. For example, if a monitored user is determined to enter a geographic area determined to correspond to a bowling alley venue or a fitness center venue, the classifier used to predict a "fall state" is a classifier that has been trained to recognize a fall state while bowling, or engaged in otherwise active behavior which approximates that of bowling behavior, since it is likely that normal activity in such environments may produce acceleration data mimicking a fall state. More generally, different classifiers can correspond to different venues, wherein given the same input data, a particular classifier corresponding to a particular venue is configured to be more or less likely to predict a particular user state than a default classifier not corresponding to a venue or a classifier corresponding to another venue. Thus, for example, the accelerometer output corresponding to a fall while bowling may be different from output generated by walking. Employing a different classifier for each user state can improve the probability for detecting a targeted behavior. In one example implementation, the geographic area corresponding to the determined venue can correspond to a higher or lower threshold for predicting the user state than a geographic area not corresponding to the venue.

The notification manager 20 is further configured to receive predetermined condition data, for example from a monitoring user, and predict the user state of a monitored user using the classifier engine 34 based on the sensor data and the predetermined condition data. The predetermined condition can correspond to a predetermined schedule stored in the schedule database 26, wherein the user state is predicted based on a classifier determined by the predetermined schedule. For example, the predetermined condition data can include an indication of when the first user is scheduled to be medicated. A first classifier for predicting the user state corresponds to a period when the monitored user is not scheduled to be medicated. A second classifier for predicting the user state corresponds to a period when the monitored user is scheduled to be medicated, or more specifically, a predetermined period of time after medication is scheduled to be administered. The user state of the monitored user is predicted based on the first classifier during the period when the monitored user is not scheduled to be medicated, and the user state of the monitored user is predicted based on the second classifier when the monitored user is scheduled to be medicated. A plurality of different classifiers can be trained for a plurality of different medications, wherein different classifiers correspond to different medications, and user state determinations are influenced by the particular medication scheduled to be administered.

Alternatively, a designation that a user is not scheduled to be medicated or is scheduled to be medicated with a particular medication can be provided as an input to a single classifier for determining the user state. The single classifier can be trained with data that includes a factor describing whether the user is in a medicated state, has been recently medicated, is in a state such that the prime side effects of the medication may be evident, or the user is in a post-medicated state where the likelihood of the manifestation of a side effect is relatively small. For example, the classifier can be trained such that it is more likely to determine a particular user state (e.g. a fall state, an unconscious state, a wandering state, or a seizure state) when the user is scheduled to be medicated. In training the classifier, the notification manager 20 via the classifier engine 34 can determine one or more effects or side-effects of the medication which is scheduled to be administered. For example, a parameter of a classifier for determining a fall state or unconscious state can correspond to a predetermined time period after a drowsiness-causing medication is scheduled to be administered. As an additional benefit, the notification manager 20 via the alert interface 32 can provide a reminder notification to the monitored user when the scheduled time for the monitored user to take medication arrives.

In one example implementation, a first threshold for predicting the user state corresponds to a period when the monitored user is not scheduled to be medicated. A second threshold for predicting the user state corresponds to a period when the monitored user is scheduled to be medicated, or more specifically, a predetermined period of time after medication is scheduled to be administered. The user state of the monitored user is predicted based on the first threshold during the period when the monitored user is not scheduled to be medicated, and the user state of the monitored user is predicted based on the second threshold during the period when the monitored user is scheduled to be medicated. The second threshold can correspond for example to a lower threshold such that for given data input (e.g. position data, acceleration data), it is more likely to predict a particular user state (e.g. a fall state, an unconscious state, a wandering state, or a seizure state) when the user is scheduled to be medicated.

The predetermined condition data can alternatively include an indication of one or more disabilities or medical conditions associated with the monitored user. For example, a parameter of a classifier for determining a fall state or unconscious state can correspond to a monitored user indicated as having a physical disability, a parameter of a classifier for determining a seizure state can correspond to a monitored user indicated as having a history of seizures, and a parameter of a classifier for determining a wandering state can correspond to a monitored user indicated as diagnosed with a cognitive disability. The seizure state can be predicted for example based on acceleration data from an accelerometer and the indication of one or more disabilities or medical conditions associated with the monitored user. For example, as compared to a monitored user without disability, a lower threshold for determining a fall state or unconscious state can correspond to a monitored user indicated as having a physical disability, a lower threshold for determining a seizure state can correspond to a monitored user indicated as having a history of seizures, and a lower threshold for determining a wandering state can correspond to a monitored user indicated as diagnosed with a cognitive disability.

The predetermined condition data can alternatively include an indication that a monitored user is scheduled to be performing a particular physical activity. A first classifier for predicting the user state corresponds to a period when the monitored user is not scheduled to be performing the particular physical activity. A second classifier for predicting the user state corresponds to a period when the monitored user is scheduled to be performing the particular physical activity. The user state of the monitored user is predicted based on the first classifier during the period when the monitored user is not scheduled to be performing the particular physical activity, and the user state of the monitored user is predicted based on the second classifier when the user is scheduled to be performing the particular physical activity. Different classifiers for determining a fall state, a seizure state or an unconscious state can correspond to a time period where a monitored user is scheduled to be participating in a physical activity such as bowling, or jogging to decrease the risk of a false determination of a fall state, a seizure state or an unconscious state.

For example, a first classifier (e.g. a default classifier) can be used for predicting the user state when the monitored user is not scheduled to be performing a particular physical activity, and a second classifier can be used when the monitored user is scheduled to be performing the particular physical activity, which second classifier is trained for predicting the user state when the monitored user is engaged in the particular physical activity. A plurality of different classifiers respectively weighted towards particular physical activities can be trained for predicting user state when the monitored user is scheduled to be performing the particular physical activities. For example, a particular classifier different from a default classifier(s) can be used for determining a fall state, a seizure state or an unconscious state when a monitored user is scheduled or determined to be bowling, and another classifier can be used for determining such state when the user is scheduled or determined to be jogging. Alternatively, a designation that a user is scheduled or determined to be performing a particular physical activity can be provided as an input to a single classifier (e.g. the default classifier). Alternatively, monitoring of a user can be discontinued entirely during such time when the monitored user is scheduled or determined to be participating in a particular physical activity.

In an example implementation, a first threshold for predicting the user state corresponds to a period when the monitored user is not scheduled to be performing the particular physical activity, a second threshold for predicting the user state corresponds to a period when the monitored user is scheduled to be performing the particular physical activity, and the user state of the monitored user is predicted based on the first threshold during the period when the monitored user is not scheduled to be performing the particular physical activity, and the user state of the monitored user is predicted based on the second threshold when the user is scheduled to be performing the particular physical activity. The second threshold can correspond for example to a higher threshold such that for given data input (e.g. position data, acceleration data), it is less likely to predict a particular user state (e.g. a fall state, an unconscious state, a wandering state, or a seizure state) when the user is scheduled to be performing the particular physical activity.

A monitored user such as a child riding to or from school, walking to a friend's house, or playing at a park can correspond to a location or a plurality of locations along a route and a time period. A child riding to school on a designated road during a set period of time can be rendered by the location determination system, such as the GPS 15 on a mobile device 12 or other location determining system as a series of locates, designating a path, that occur within a designated time period. A user state corresponding to an emergency situation can be predicted via the notification manager 20 and monitoring agent 13 based on a monitored user's deviation from a predetermined route or activity based on sensor data including one or more of position data, velocity data, and acceleration data. It can be determined from sensor data that the monitored user is located outside of a predetermined route for a predetermined time period, and an emergency situation can be predicted based on such determination. For example, a monitored child instead of riding his/her bicycle to school, rides to a location of known drug dealers, which is outside of a particular predetermined route. If the deviation from the predetermined route exceeds fifteen minutes, an emergency situation is predicted. An emergency situation can also be predicted based on the determination that the monitored user fails to move from a location on a predetermined route for a predetermined period of time. For example, if a monitored user is biking and his/her bike experiences a flat tire, the user may stop to fix the tire triggering prediction of an emergency situation.

Referring to FIG. 1, the accelerometer 17 and location determination system, such as the GPS 15 or other location determining system can provide data used to classify the activity occurring at these locations, for example that a child carrying the mobile device 12 is walking, riding a bicycle, or riding in a motor vehicle. A mode of transportation, e.g. pedestrian, biking, or driving, can be determined based on the sensor data, for example producing a velocity/acceleration signature, and an emergency situation can be determined based on a determination that the mode of transportation differs from a predetermined mode of transportation or a predetermined mode of transportation associated with a particular route. For example, the predetermined transportation mode can be one or both of a biking mode and a pedestrian mode, and the emergency situation can be predicted if it is determined that the monitored user is in a driving mode. For example, a parent can be notified if their child, who is expected to walk home from school at a particular time, is determined based on velocity data and acceleration data from the child's mobile device 12 to be in a motor vehicle at that particular time. The predetermined mode of transportation can be dependent on one or more of a time of day, level of ambient light, whether it is day or night, and a location along a predetermined route, such that for example detecting a particular mode of transportation at certain times or along certain routes may trigger a determination of an emergency situation, but detecting the particular mode of transportation at other times or along other routes may not trigger the determination of the emergency situation.

Information corresponding to the monitored user's route and activity travel patterns can be obtained for comparison with current travel activity. Pattern information can correspond to one or more of a predetermined route, a predetermined mode of transportation, and predetermined corresponding time periods. The pattern information can be explicitly defined by a caretaker or other monitoring user. For example, a monitoring user can provide an indication that the monitored user rides his/her bicycle to school on a designated road during a designated time of day on designated days. Alternatively, the pattern information can be inferred by past actions, for example a determination can be made by the notification manager 20 based on historical data that the monitored user rides his/her bicycle to school on a particular road during a particular time of day on particular days. Sensor data comprising one or more of position, velocity and acceleration information can be received over a period of time, and a pattern can be determined based on the sensor data. For example by detecting over a period of time that during the same approximate time period each weekday a monitored user rides a bicycle between two particular locations, it can be determined that this behavior is a pattern expected to be repeated in the future. Current sensor data comprising one or more of position data, velocity data, and acceleration data is compared with obtained pattern information or a determined pattern. A user state corresponding to an emergency situation is predicted based on a comparison of current sensor data with the obtained pattern information or determined pattern.

The invention further provides for explicitly indicating to a mobile device that conditions conducive to an emergency situation exist. Such conditions can be resolved on a central network-accessible system implementing the notification manager 20. Conditions local to a particular mobile device are used as the basis for enabling, via a network, the mobile device 12 to activate an emergency situation response. Such condition may include an environmental event. A user state corresponding to an emergency situation can be predicted based on receipt of an indication of a location of an environmental event. The current location of a monitored user is compared with the location of the environmental event, and an emergency situation is predicted responsive to the current location of the monitored user corresponding to the location of the environmental event. The environmental event can include for example a hostile weather condition, a geological condition such as an earthquake, and reported criminal activity such as rioting or an assailant at or suspected at a particular location corresponding to the current location of the monitored user. The position of the environmental event can be at the same location as, a predetermined distance from, or positioned in other suitable relation relative to the current location of the monitored user to trigger the prediction that the emergency situation exists.

An emergency situation can further be predicted responsive to a monitored user walking late at night or walking in an area with a reported high crime rate. The monitored user is also able to manually initiate transmission of notification of an emergency situation to the notification manager via a user interface 19 enabled by the monitoring agent 13 on the mobile device 12, triggering transmission of a notification to a monitoring user. For example a child feeling threatened may actuate a button on their mobile device 12 indicating a particular emergency situation.

The monitoring agent 13, or alternatively, the notification manager 20, preferably enables the user interface 19 on the mobile device 12 to provide a button allowing direct communication with a monitoring user via telephone or other communication protocol responsive to actuation of the button by the monitored user. The button is preferably rendered visible and enabled by the user interface 19 responsive to a prediction of an emergency situation. Accordingly, communication with a monitoring user using the mobile device 12 is facilitated during a predicted emergency situation which may be especially beneficial for example if the monitored user is injured or disabled.

Additional data gathering on the mobile device 12 is enabled responsive to predicting the emergency situation, receiving confirmation of the predicted emergency situation, and the monitored user's failure to respond to a request to confirm the predicted emergency situation. The notification manager 20 and/or the monitoring agent 13 can enable data gathering elements to create a record of the emergency situation which may aid in the resolution of the emergency. Gathered data is transmitted to and stored remotely by a network accessible system preferably implementing the notification manager 20.

Gathered data can include audio and video data. Audio recording and video recording on the mobile device 12 can be enabled responsive to one or more of predicting the emergency situation, receiving confirmation of the predicted emergency situation, and the monitored user's failure to respond to a request to confirm the predicted emergency situation. An audio/video application 21 communicates with the monitoring agent 13 for control of audio and video recording hardware on the mobile device 12 to render time-stamped audio and/or video recordings. Recorded audio and video can be transmitted to the monitoring user via the notification manager 20, for example to help them appraise the seriousness of the emergency situation. A classifier can be run on ambient audio to determine the environment of the monitored user. For example, the classifier may determine from the ambient audio that the monitored user is in an urban area, on a busy street, or in a park. Further, the classifier can determine if there are people talking nearby. It is also possible for the monitored user to hold the audio gathering device to various parts of their body, to perform preliminary diagnostic analysis by detecting a bodily function. For example, the monitored user can hold the audio gathering device over their heart, and a classifier can be run against the collected heart audio pattern to determine if a possible heart attack is in progress.

Gathered data can further include location data. Active location monitoring and recording can be activated on the mobile device 12 to render time-stamped location records, for example using the location determination system, such as the GPS receiver 15 or cell site interpolation, responsive to one or more of predicting the emergency situation, receiving confirmation of the predicted emergency situation, and the monitored user's failure to respond to a request to confirm the predicted emergency situation. Recorded location information can be transmitted to a monitoring user via the notification manager 20, for example information useful to locate a monitored user who may be disabled and unable to provide information regarding their whereabouts.

Gathered data can further include communication records. The monitoring agent 13 or notification manager 20 is configured to record one or more of the last phone number called, the last call detail record ("CDR"), the last electronic message sent (e.g. text message), the last electronic message received, the last web page visited, the last photograph recorded, and the last video recorded responsive to one or more of predicting an emergency situation, receiving confirmation of a predicted emergency situation, and the monitored user's failure to respond to a request to confirm the predicted emergency situation. This information can be gathered for example by accessing a communication database 23 on the mobile device 12, or alternatively, by accessing telecommunication carrier communication records or other record repository on a network accessible system. This information can be transmitted to a monitoring user and may be useful for example to provide insight regarding events leading up to an emergency situation or medical anomaly.

The notification manager 20 is configured to detect and record identifying information of one or more other mobile devices 18 corresponding to one or more other users within an area, which area is defined by the position of the monitored user, for example one or more other users in a particular geographic area of predetermined size surrounding and within a predetermined distance of the monitored user. Detecting and recording the identifying information is performed responsive to one or more of predicting the emergency situation, receiving confirmation of the predicted emergency situation, and the monitored user's failure to respond to a request to confirm the predicted emergency situation. This information may be useful for example for determining other users which may have witnessed events leading to the emergency situation.

Additionally, notification can be provided to the monitoring user regarding other users which are not typically in the particular geographic area during the time period corresponding to the predicted emergency situation. That is for example, the notification manager 20 can determine a frequency at which the one or more other mobile devices 18 and corresponding other users have been positioned within the particular geographic area, and a notification can be provided to the monitoring user regarding users in the particular area during the emergency situation responsive to the determined frequency being less than a predetermined value. This information may also be useful for example for determining other users which may have information concerning the emergency situation.

Figure 3:
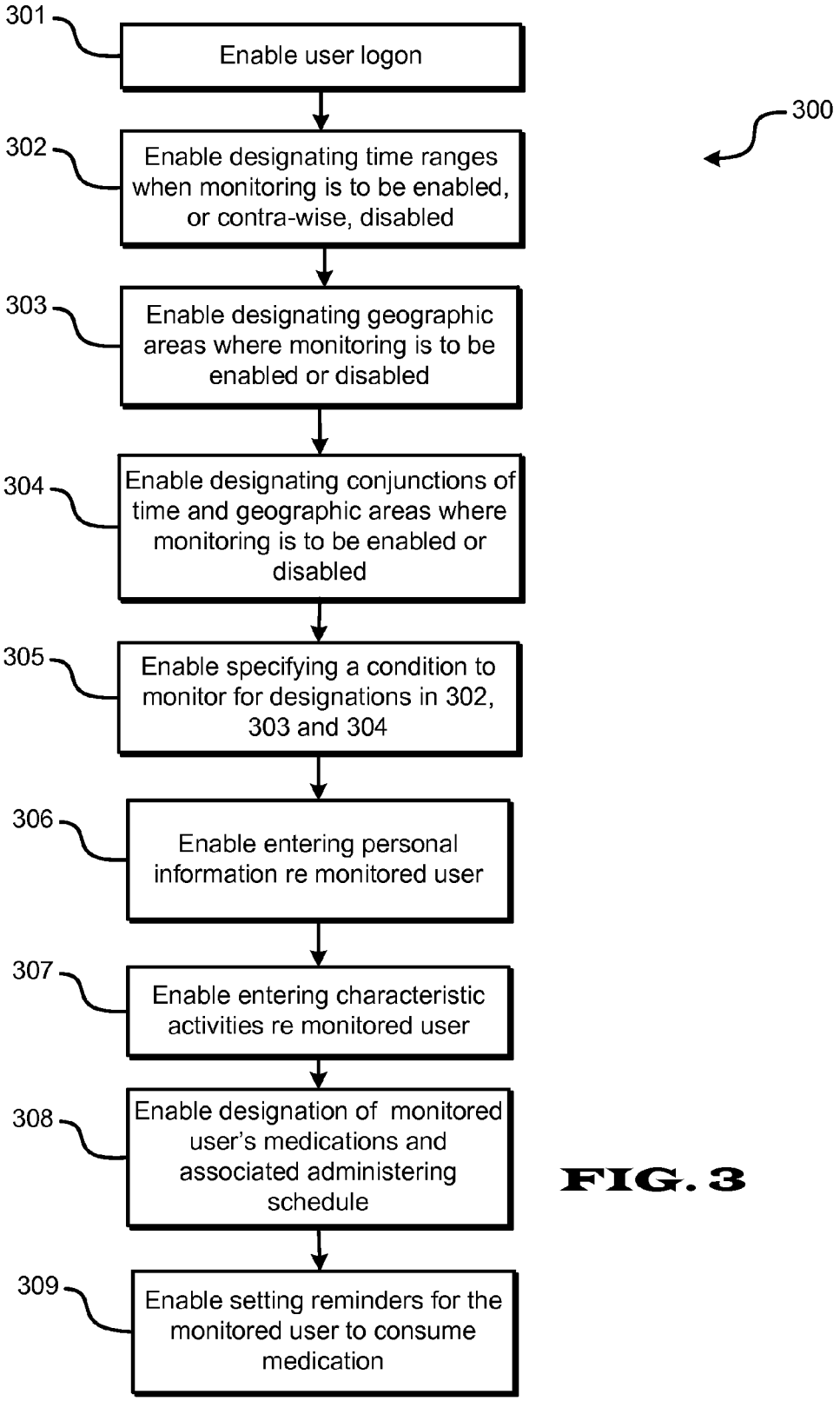
FIG. 3 is a diagram showing a user configuration process for enabling monitoring of a mobile communication device according to the invention.

Referring to FIG. 3, a user configuration process is shown for enabling monitoring of a mobile communication device 12 via the notification manager 20. In a step 301, the notification manager enables a monitoring user to login from a client device 16 via the configuration application 22. The monitoring user is enabled to designate time ranges when monitoring is to be enabled, or contra-wise, disabled (step 302). The monitoring user is enabled to designate geographic areas where monitoring is to be enabled, or contra-wise, disabled (step 303). The monitoring user is enabled to designate conjunctions of time and geographic areas where monitoring is to be enabled or disabled (step 304). The monitoring user is also enabled to specify a condition to monitor for each of the entries defined in step 302, 303, and 304 (step 305), for example monitor for lack of motion or an unconscious state if a current position of a monitored device 12 corresponds to a tennis court. Alternatively, the monitoring user can specify conditions to bypass for such entries, for example do not monitor for inactivity or an unconscious state in the monitored user's bedroom between 11 pm and 8 am. The monitoring user is enabled to enter personal information about the monitored user, such as their birth date, name, ambulatory state (e.g. walking, using crutches, wheelchair, bedridden), or other identifying information or indication of disability (step 306). The monitoring user is enabled to enter information about activities in which the monitored user characteristically engages, such as walks in the park (indicating the location of the park), bowling, location of doctors' offices frequented by the monitored user, or indications of other activities commonly performed by the monitored user (step 307). The monitoring user is further enabled to input medications that the monitored user is currently taking, and the schedule the monitored user is to follow in taking this medication (step 308), which input can be maintained in the schedule database 26. The notification manager 20 via the classifier engine 34 is configured to determine effects and side-effects that may result from specified medications. The monitoring user is further enabled to set the system to notify the monitored user when the monitored user should be taking certain medication (step 309).

The mapping engine 36 may also deduce locations, and times that the monitored user frequents the locations, and suggest these to the monitoring user for registry (steps 302 and 303). For example, the mapping engine 36 may determine that the monitored user remains at 123 Main St. on Monday, Wednesday, and Friday between 4:00 PM and 5:00 PM, and suggest to the monitoring user via the configuration application 22 that this may be a location and time period for which explicit activity monitoring can be applied. The monitoring user may for example designate this location as corresponding to the home of a friend of the monitored user that the monitored user is visiting during the particular time period on the particular days.

An example implementation of the system 10 and associated method 200 follows. The system 10 via the monitoring agent 13 monitors the monitored user based on data from the mobile device location determination system, such as the GPS receiver 15 and accelerometer 17, passing the collected data through one or more classifiers to decide whether a medical anomaly, vehicle accident or other emergency situation has been detected. If the monitored user has recently (within a predetermined time period) taken medication with possible medical anomaly causation, this information is included as an input to the classifier. Other state data such as location, time of day, and projected activity, if available, are included as inputs to the classifier or classifiers. When a user state is determined, for example via the classifier engine 34, the alert interface 32 or other system component contacts the monitored user, for example via the mobile device 12, and requests that the monitored user verify their current state. For example, if the monitored user is determined to be potentially unconscious ("unconscious state"), a phone call initiated via the alert interface 32 can ask that the user press the number "7" on their phone to validate that they are not unconscious. If the user is determined to have possibly fallen ("fall state"), the notification manager 20 can call the monitored user via the alert interface 32, and request that the monitored user press the number "7" to indicate that they are fine, or the number "3" to indicate that they have fallen, or say, "I have fallen." The alert interface 32 is enabled to recognize a collection of phrases that may be spoken by the user that indicate the state of the user. If the user is detected to be wandering erratically ("wandering state"), the user can be provided a series of questions to ensure clarity of thought, such as "enter the day of the week, with Sunday being 1", "enter the sum of 5+8", "enter year of birth", or other suitable test questionnaire. If the monitored user is able to signal to the notification manager 20 that the monitored user is fine (e.g. the predicted user state is invalid), the system saves the detected location and accelerometer readings that lead to the erroneously detected anomaly for further analysis or to retrain the classifier. If the monitored user is not able to signal that the monitored user is fine after a predetermined period of time, for example 1 minute, or the monitored user signals that he or she is experiencing an anomalous medical condition (e.g. the predicted user state is valid), the notification manager 20 via the alert interface 32 contacts the monitoring user, for example via a client device 16, and provides the monitoring user the current location of the monitored user. The notification manager 20 is configured to give the monitoring user a continuous update as to the location of the user. The notification manager 20 also provides an update to the monitoring user as to the detected anomalous medical condition or other emergency situation corresponding to the user state.

The classifier engine 34 is configured to determine one or more user states, classifiers for which can be stored for example in the state database 28. In determining the "fall state" the accelerometer 17 on the mobile device 12 is a source of data to detect the rapid vertical acceleration indicative of a falling condition. Further accelerometer readings signaling a post fall state in conjunction with locations and other device position data derived from the mobile device location determination system, such as the GPS 15 are used to confirm the fall state. It can be useful to apply other classifiers (not connected with the classifier to determine the fall state) to this data to determine the possibility that the user may be engaged in a particular activity and has not fallen. For example, a driving classifier can be applied to the same accelerometer and location data to determine the possibility that the monitored user may be driving. Other classifiers can be applied to the data to determine if the monitored user is for example playing tennis, bowling, jogging or participating in another activity corresponding to a particular unique user state. If it is determined that another user state corresponds to the data, the threshold for determining a fall state can be increased or a determination of a fall state can be precluded. For example, the weighting of the classifier for determining the fall state can be modified responsive to determining the other user state. The mapping engine 36 can attempt to derive the venue of the location in which the fall may have occurred. The determination of the venue can be included as an input to the classifier. For example, if it is determined that the venue is a bowling alley, and the user has a personal preference for bowling, this will act to decrease the probability that a fall has been detected, that is increase the threshold for determining the fall state for the corresponding geographic area.

The classifier engine 34 is further configured to determine the "unconscious state". The accelerometer 17 on the mobile device 12 is a source of data to detect relative inactivity that is indicative of the unconscious state. This data can be combined with data about the monitored user, such as geographic areas or venues where the monitoring user has indicated that the monitored user is likely to be in an active state, geographic areas where the monitoring user has indicated that the monitored user is likely to be in a passive state, or times when the monitoring user has designated that the monitored user is likely to be active or passive. Condition data, for example indicating that the user recently took medication which may induce an unconscious state, can also be included as input to the classifier.

The classifier engine 34 is further configured to determine the "wandering state". Erratic wandering is a behavior that can be expressed by users suffering from some form of dementia or other cognitive disability. A classifier which combines location, accelerometer readings, and location finder derived (e.g. GPS derived) velocity can be used to determine erratic wandering. Periodic location sampling can be used to determine if there is a consistent intention of direction, as opposed to what is classified as a random walk. Accelerometer reading can be used to determine if the gait of walking is undirected, staggering, or characterized by frequent stops and starts. Location finder derived velocity can be used to determine if the user is in a moving vehicle, such as a bus, train or car. Location outside of a geographic area can be used to determine that user is outside of a predetermined "safe zone". These data sources can be input to the classifier to make the determination as to the wandering state.

The classifier engine 34 is further configured to determine the "seizure state". Seizures are characterized by rhythmic muscle contractions. A classifier can take accelerometer data and location finder data (e.g. GPS data) to determine the onset and duration of a seizure. Accelerometer data which records the rhythmic muscle contractions characteristic of muscle spasms can be fed to the classifier. Seizures are characterized by immobilized user behavior. Location data can be used to detect that the monitored user is not moving.

The classifier engine 34 is further configured to determine the "vehicular accident state". The accelerometer 17 on the mobile device 12 is a source of data to detect the rapid deceleration indicative of a falling condition. The GPS 15 or other location determining system is a source of data to detect a rapid change from a velocity indicative of motor vehicle travel to a much lesser velocity or lack of velocity.

Some medications may cause seizures. Pregnancy can be a factor in seizures. Pre-existing conditions such as epilepsy, brain tumors, low blood sugar, parasitic infections, or other disability may be a factor in the likelihood of a seizure. These factors, provided by the monitoring user or other source, can be included as inputs to the classifier for determining the likelihood that the user is having a seizure. If a seizure is detected, the time at which it is detected and the duration of the seizure can be recorded by notification manager 20 and reported to the monitoring user.

Figure 4:
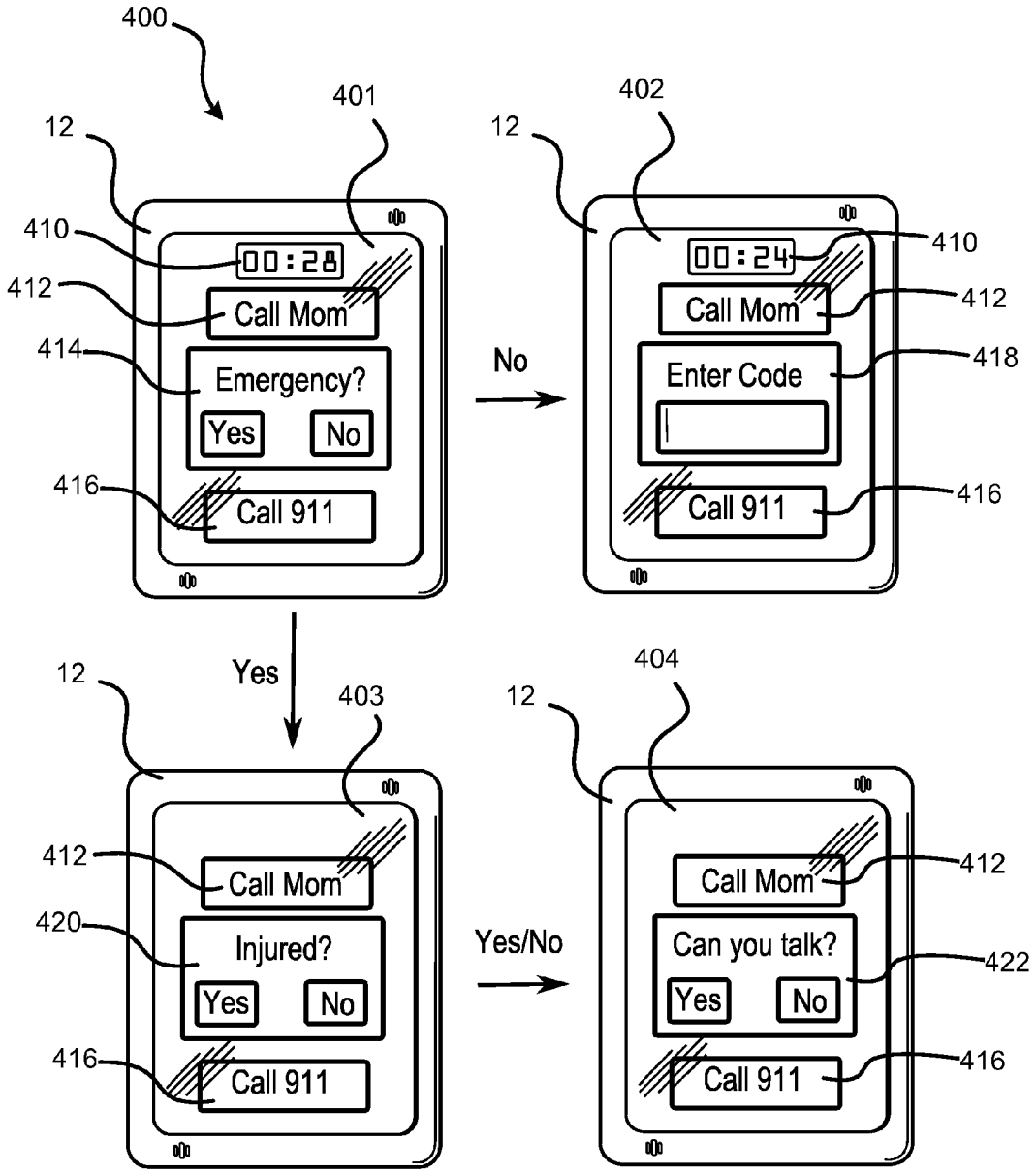
FIG. 4 shows a user interface sequence according to the invention.

FIG. 4 shows a user interface sequence 400 enabled by the monitoring agent 13 and the notification manager 20 on the mobile device 12 pursuant to the invention. Responsive to predicting an emergency situation according to the method of FIG. 2, the monitoring agent 13 prompts the user interface 19 of the mobile device to provide a display 401. The display 401 includes an emergency query area 414 with "Yes" and "No" buttons with which a user can confirm ("Yes") or refute ("No") the existence of an emergency situation. Further responsive to a prediction of an emergency situation, a button 412 is provided for initiating telephone communication with a particular monitoring user, in this case the monitored user's mother. Another button 416 is provided for initiating telephone communication with another monitoring user, in this case a 911 call center. Responsive to user actuation of the button 412 or the button 416, the mobile device respectively initiates a telephone call to the user's mother or the 911 call center. Responsive to a user's actuation of the "Yes" button or "No" button in the emergency query area 414, a corresponding indication is transmitted to the notification manager 20 for notifying a monitoring user regarding the predicted emergency situation. A timer controls a displayed timer window 410, wherein if a monitored user fails to respond via the emergency query area 414 within the displayed time period, a corresponding indication is provided to the notification manager 20 via the monitoring agent 13.

If the monitored user actuates "No" in the emergency query area 414, an authentication area 418 is provided in a display 402, wherein the monitored user must enter a code (e.g. password). If the code is not entered or not entered correctly a corresponding indication is transmitted to the notification manager 20 via the monitoring agent 13. This feature is useful to prevent someone other than the monitored user from wrongly indicating that no emergency situation is present.

If "Yes" is actuated in the emergency query area 414, an injury query area 420 is provided in a display 403, wherein the monitored user must indicate if he/she is injured. An indication of the user's response, or the user's lack of a response within a predetermined time period, is transmitted to the notification manager 20 via the monitoring agent 13. After receiving a response via the injury query area 420, the monitoring agent 13 provides a display 404 with a verbal communication query area 422 asking the monitored user if they are able to verbally communicate ("Can you talk?"). An indication of the user's response, or the user's lack of a response within a predetermined time period, is transmitted to the notification manager 20.

Based on user response or lack of response to the interface sequence 400, the notification manager 20 is configured to provide notifications to the monitoring user, for example via a client device 16, based on the indications from the monitoring agent 13. For example, if "Yes" is indicated by the user in emergency query area 414, or no response is received within 30 seconds of initiating the display 401 (as shown by the timer window 410), a notification of an emergency situation is sent to a monitoring user. If "No" is indicated, and a valid authentication code is entered in the authentication area 418, the notification manager 20 can abstain from transmitting any notification to the monitoring user, or alternatively, can send a notification to the monitoring user that a predicted emergency situation was refuted by the monitored user. The monitoring user is further notified of the responses solicited via the injury query area 420 and the verbal communication query area 422, or the lack thereof.

While embodiments of the invention have been described in detail above, the invention is not limited to the specific embodiments described above, which should be considered as merely exemplary. Further modifications and extensions of the invention may be developed, and all such modifications are deemed to be within the scope of the invention as defined by the appended claims.

What is claimed is:

1. A computer-implemented method for monitoring and reporting mobile device user activity comprising:

receiving sensor data from a mobile device corresponding to a first user;

predicting an emergency situation corresponding to the first user based on the sensor data;

transmitting a request to the first user to confirm the predicted emergency situation; and transmitting a notification regarding the predicted emergency situation to a second user responsive to at least one of the first user's confirmation of the predicted emergency situation and the first user's failure to respond to the request.

2. The computer-implemented method of claim 1, further comprising receiving details regarding the predicted emergency situation from the first user responsive to the request to confirm.

3. The computer-implemented method of claim 2, further comprising selecting the second user from a plurality of users based on the details received from the first user.

4. The computer-implemented method of claim 2, wherein the details comprise at least one of an indication of whether the first user is injured or disabled, an indication of a degree of injury of the first user, and an indication of a degree of injury of the first user.

5. The computer-implemented method of claim 1, further comprising selecting the second user from a plurality of users based on at least one of the predicted emergency situation and whether or not a confirmation is received from the first user responsive to the request.

6. The computer-implemented method of claim 1, wherein receiving the sensor data comprises receiving position data, the method further comprising:

determining based on the sensor data that the first user has deviated from a predetermined route; and predicting the emergency situation based on the determination that the first user has deviated from the predetermined route.

7. The computer-implemented method of claim 6, further comprising:

further comprising receiving the sensor data over a period of time; and determining a pattern based on the sensor data received over the period of time, wherein the predetermined route corresponds to the pattern.

8. The computer-implemented method of claim 1, wherein receiving the sensor data comprises receiving position data, the method further comprising:

determining based on the sensor data that the first user is located outside of a predetermined route for a predetermined time period; and predicting the emergency situation based on the determination that the first user is located outside of a predetermined route for a predetermined time period.

9. The computer-implemented method of claim 1, wherein receiving the sensor data comprises receiving at least one of position data and velocity data, the method further comprising:

determining based on the sensor data that the first user fails to move from a location on a predetermined route for a predetermined period of time; and predicting the emergency situation based on the determination that the first user fails to move from a location on a predetermined route for a predetermined period of time.

10. The computer-implemented method of claim 1, wherein receiving the sensor data comprises receiving at least one of position data, velocity data and acceleration data, the method further comprising:

determining based on the sensor data a mode of transportation of the first user; and predicting the emergency situation based on the determination that the mode of transportation differs from a predetermined mode of transportation.

11. The computer-implemented method of claim 10, further comprising: determining the mode of transportation based on a velocity/acceleration signature of the first user.

12. The computer-implemented method of claim 10, wherein the predetermined mode of transportation is dependent on at least one of a time of day and a location along a predetermined route.

13. The computer-implemented method of claim 10, wherein the predetermined mode of transportation is at least one of a bicycle mode and a pedestrian mode; the method further comprising predicting the emergency situation if the determined mode of transportation is a driving mode.

14. The computer-implemented method of claim 10, wherein the predetermined mode of transportation corresponds to a pattern determined based on sensor data received over time.

15. The computer-implemented method of claim 1, wherein receiving the sensor data comprises receiving at least one of position data, velocity data and acceleration data, the method further comprising:

obtaining pattern information corresponding to at least one of position, velocity and acceleration of the first user during at least one time period;

comparing current sensor data with the pattern information; and predicting the emergency situation based on the comparison of the current sensor data with the pattern information.

16. The computer-implemented method of claim 15, further comprising obtaining the pattern information from the second user.

17. The computer-implemented method of claim 1, wherein receiving the sensor data comprises receiving at least one of position data, velocity data and acceleration data, the method further comprising:

obtaining at least one of position data, velocity data and acceleration data corresponding to the first user over a period of time;

determining a pattern based on the at least one of the position data, the velocity data and the acceleration data corresponding to the first user over the period of time;

comparing current sensor data with the determined pattern; and predicting the emergency situation based on the comparison of the current sensor data with the determined pattern.

18. The computer-implemented method of claim 1, wherein the sensor data comprises a current location of the first user, the method further comprising:

receiving an indication of a location of an environmental event;

comparing the current location of the first user with the location of the environmental event; and predicting the emergency situation responsive to the current location of the first user corresponding to the location of the environmental event.

19. The computer-implemented method of claim 18, wherein the environmental event comprises at least one of a weather condition and a geological condition.

20. The computer-implemented method of claim 18, wherein the environmental event comprises reported criminal activity.

21. The computer-implemented method of claim 1, wherein receiving the sensor data comprises receiving at least one of position data, velocity data and acceleration data, the method further comprising:

determining based on the sensor data a mode of transportation of the first user; and comparing the determined mode of transportation with at least one of a time of day and a level of ambient light;

predicting the emergency situation based on the comparison of the determined mode of transportation and the at least one of the particular time of day and the particular level of ambient light.

22. The computer-implemented method of claim 21, wherein the at least one of the particular time of day and the particular level of ambient light corresponds to night time.

23. The computer-implemented method of claim 1, further comprising providing a user interface of the mobile device with a button enabling direct communication with the second user responsive to predicting the emergency situation.

24. The computer-implemented method of claim 1, further comprising activating at least one of audio recording and video recording on the mobile device responsive to at least one of predicting the emergency situation, receiving confirmation of the predicted emergency situation, and the first user's failure to respond to the request to confirm the predicted emergency situation.

25. The computer-implemented method of claim 24, further comprising providing the at least one of the audio recording and video recording to the second user.

26. The computer-implemented method of claim 24, further comprising resolving the at least one of the audio recording and video recording using a classifier to predict the emergency situation.

27. The computer-implemented method of claim 24, further comprising:

detecting a bodily function of the first user based on the at least one of the audio recording and video recording; and predicting the emergency situation based on the detected bodily function.

28. The computer-implemented method of claim 1, further comprising activating location monitoring and recording on the mobile device responsive to at least one of predicting the emergency situation, receiving confirmation of the predicted emergency situation, and the first user's failure to respond to the request to confirm the predicted emergency situation.

29. The computer-implemented method of claim 28, further comprising providing recorded location to the second user.

30. The computer-implemented method of claim 1, further comprising recording at least one of the last phone number called, the last call detail record, the last electronic message sent, the last electronic message received, the last web page visited, the last photograph recorded, and the last video recorded responsive to at least one of predicting the emergency situation, receiving confirmation of the predicted emergency situation, and the first user's failure to respond to the request to confirm the predicted emergency situation.

31. The computer-implemented method of claim 30, further comprising providing the at least one of the last phone number called, the last call detail record, the last electronic message sent, the last electronic message received, the last web page visited, the last photograph recorded, and the last video recorded to the second user.

32. The computer-implemented method of claim 1, further comprising detecting and recording identifying information of at least one other mobile device corresponding to at least one other user within a geographic area defined by the position of the first user responsive to at least one of predicting the emergency situation, receiving confirmation of the predicted emergency situation, and the first user's failure to respond to the request to confirm the predicted emergency situation.

33. The computer-implemented method of claim 32, wherein the geographic area defined by the position of the first user is an area within a predetermined distance from the first user.

34. The computer-implemented method of claim 32, determining a frequency at which the at least one other user has been positioned within the geographic area, and providing a notification to the second user regarding the at least one other user responsive to the determined frequency being less than a predetermined value.

35. The computer-implemented method of claim 1, repeating transmission of the request at a predetermined time interval.

36. The computer implemented method of claim 1, further comprising resolving the sensor data using a classifier to predict the emergency situation.

37. The computer implemented method of claim 36, wherein the classifier comprises a plurality of components respectively corresponding to a plurality of emergency situations, wherein each component is configured to resolve a particular collection of inputs to predict a respective one of the plurality of emergency situations.

38. The computer implemented method of claim 36, further comprising:

receiving from the first user a confirmation that the prediction of the emergency situation is valid or an indication that the prediction of the emergency situation is invalid; and applying the sensor data to the classifier with the indication that the prediction of the emergency situation is valid or invalid to retrain the classifier.

39. The computer implemented method of claim 1, further comprising:

receiving training data comprising sensed data and an indication of at least one known emergency situation corresponding to the sensed data;

training a classifier using the training data; and applying the classifier to the sensor data to predict the emergency situation.

40. The computer implemented method of claim 1, further comprising applying a plurality of classifiers to the sensor data to predict the emergency situation, wherein each classifier corresponds to at least one unique emergency situation.

41. The computer implemented method of claim 1, further comprising transmitting a notification regarding the predicted emergency situation to the second user responsive to the first user's failure to respond to the request within a predetermined period of time.

42. The computer implemented method of claim 1, wherein the sensor data comprises acceleration data and velocity data, and wherein the predicted emergency situation comprises a vehicular accident.

43. The computer-implemented method of claim 1, further comprising receiving a response from the first user comprising an identifying code responsive to the request to confirm.

44. A computing system including at least one non-transitory memory comprising instructions operable to enable the computing system to perform a procedure for monitoring and reporting mobile device user activity, the procedure comprising:

receiving sensor data from a mobile device corresponding to a first user;

predicting an emergency situation corresponding to the first user based on the sensor data;

transmitting a request to the first user to confirm the predicted emergency situation; and transmitting a notification regarding the predicted emergency situation to a second user responsive to at least one of the first user's confirmation of the predicted emergency situation and the first user's failure to respond to the request.

45. Non-transitory computer-readable media tangibly embodying a program of instructions executable by a processor to implement a method for monitoring and reporting mobile device user activity, the method comprising:

receiving sensor data from a mobile device corresponding to a first user;

predicting an emergency situation corresponding to the first user based on the sensor data;

transmitting a request to the first user to confirm the predicted emergency situation; and transmitting a notification regarding the predicted emergency situation to a second user responsive to at least one of the first user's confirmation of the predicted emergency situation and the first user's failure to respond to the request.

* * * * *